US009157630B2

(12) United States Patent
Li et al.

(10) Patent No.: US 9,157,630 B2
(45) Date of Patent: Oct. 13, 2015

(54) VENTILATION DEVICE

(75) Inventors: Gangyi Li, Guangdong (CN); Jianrong Zhu, Guangdong (CN); Shouyong Gao, Guangdong (CN)

(73) Assignees: Panasonic Ecology Systems Guangdong Co. Ltd., Guangdong (CN); Panasonic Corporation, Osaka (JP)

( * ) Notice: Subject to any disclaimer, the term of this patent is extended or adjusted under 35 U.S.C. 154(b) by 19 days.

(21) Appl. No.: 14/005,914

(22) PCT Filed: Mar. 23, 2012

(86) PCT No.: PCT/CN2012/072902

§ 371 (c)(1),
(2), (4) Date: Nov. 18, 2013

(87) PCT Pub. No.: WO2012/130096

PCT Pub. Date: Oct. 4, 2012

(65) Prior Publication Data

US 2014/0078718 A1 Mar. 20, 2014

(30) Foreign Application Priority Data

Mar. 31, 2011 (CN) ..... 2011 2 0104017 U

(51) Int. Cl.

| | |
|---|---|
| ***F21V 33/00*** | (2006.01) |
| ***F24F 7/007*** | (2006.01) |
| ***F21V 31/03*** | (2006.01) |
| ***F24F 13/078*** | (2006.01) |

(52) U.S. Cl.

CPC ..... *F21V 33/0088* (2013.01); *F21V 31/03* (2013.01); *F24F 7/007* (2013.01); *F24F 13/078* (2013.01)

(58) Field of Classification Search

CPC . F21V 33/0088; F21V 33/0096; F21V 31/03; F21V 33/00; F21V 1/00; F21V 15/00; F21V 15/015; F21V 25/00; F24F 7/007; F24F 13/078

See application file for complete search history.

(56) References Cited

U.S. PATENT DOCUMENTS 2,189,008 A * 2/1940 Kurth ..... 454/242
3,701,895 A * 10/1972 Sweetser ..... 362/264

(Continued)

FOREIGN PATENT DOCUMENTS

CN 1214434 4/1999
CN 1936340 3/2007

(Continued)

OTHER PUBLICATIONS

International Search Report for International Appln. No. PCT/CN2012/072902, dated Jun. 14, 2012.

(Continued)

*Primary Examiner* — Bao Q Truong
(74) *Attorney, Agent, or Firm* — RatnerPrestia

(57) ABSTRACT

A ventilating fan, includes a frame provided with an opening, a fan disposed in the frame, a panel covering the opening of the frame and allowing air passing through and a lighting device disposed in the panel. The lighting device includes a lampshade, in which a lighting part is placed, and a circuitry box of a controller for controlling the lighting part. A gap is formed in a connection between the circuitry box and the panel such that a water discharge structure communicated with outside of the circuitry box is formed. Advantages of the present invention includes that a gap communicated with outside of the circuitry box is provided in a connection between the circuitry box and the panel, which allows water to be discharged through the gap from inside of the panel, even water would enter into inside of the circuitry box, thus safety operation of the product is ensured.

8 Claims, 7 Drawing Sheets

(56) References Cited

U.S. PATENT DOCUMENTS

| | | | | |
|---|---|---|---|---|
| 5,021,932 | A * | 6/1991 | Ivey | 362/96 |
| 5,664,872 | A * | 9/1997 | Spearman et al. | 362/96 |
| 6,939,023 | B2 * | 9/2005 | Ivey | 362/225 |
| 7,175,309 | B2 * | 2/2007 | Craw et al. | 362/253 |
| 7,470,043 | B2 * | 12/2008 | Mehta | 362/310 |
| 8,382,332 | B2 * | 2/2013 | Zakula et al. | 362/294 |
| 8,641,375 | B2 * | 2/2014 | Tian et al. | 416/5 |
| 2005/0117341 | A1 | 6/2005 | Craw et al. | |
| 2010/0197216 | A1 * | 8/2010 | Liang et al. | 454/256 |

FOREIGN PATENT DOCUMENTS

| | | |
|---|---|---|
| CN | 101307770 | 11/2008 |
| CN | 202048640 | 11/2011 |
| JP | 2006292183 | 10/2006 |
| WO | WO 2008/032289 | 3/2008 |

OTHER PUBLICATIONS

Written Opinion for International Appln. No. PCT/CN2012/072902, dated Jun. 4, 2012.

* cited by examiner

VENTILATION DEVICE

CROSS-REFERENCE TO RELATED APPLICATIONS

This application is based on the PCT international application PCT/CN2012/072902 and claims the benefit of Chinese patent application No. 201120104017.3 filed on Mar. 23, 2012 with SIPO of China, and the disclosure of which is incorporated herein in its entirety by reference.

BACKGROUND OF THE INVENTION

1. Field of the Disclosure

The present Invention relates to a ventilation device, and particularly, to a ventilation device with a LED lighting device.

2. Description of the Related Art

FIG. 1 shows a schematic view of a conventional ventilation device. A ventilation device 10 includes a frame 12 with an opening 11, a fan 13 placed in the frame 12, and a panel 14 fixed to the frame 12 and provided with a lighting device 15. The lighting device 15 comprises a fluorescent lamp 16, a ballast (not shown), a lamp base 17, a PCB box (not shown) and a lampshade 18. The lampshade 18 is integrally formed with PCB box and made of metal or resin.

In the above mentioned ventilation device 10 of the prior art, the lighting device 15 of the ventilation device 10 is provided with a fluorescent lamp 16 where a ballast is needed. Thus, the entire volume of the ventilation device 10 becomes large. Furthermore, the cost of manufacturing and using the ventilation device 10 increases.

In order to achieve miniaturization of the lighting device 15, it is desirable to arrange the ballast adjacent to the fluorescent lamp 16. Thus, the ballast is fixed in the prior art inner side the lampshade 18 of the ventilation device 10.

When the ventilation device 10 operates, indoor air is sucked in through the lampshade 18 and passed around the lighting device 10. However, water droplets or vapor may enter inside of the lighting device 15 when the ventilation device 10 is used to discharge the air having high humidity, such as, in a bathroom. As such, it causes potential risk during operation of the ventilation device.

SUMMARY OF THE DISCLOSURE

The present invention has been made to overcome or alleviate at least one of the above-mentioned problems and drawbacks existing in the prior arts.

Accordingly, it is an object of the present Invention to provide a ventilation device which achieves an increased safety. The ventilation device including a lighting device enables rapidly discharge water even if water droplets or vapor would enter into a circuitry box for driving the lighting device, thereby enhancing durability.

In order to achieve the above mentioned objective, according to an aspect of the invention, there is provided a ventilation device comprising a frame provided with an opening, a fan disposed in the frame, a panel covering the opening of the frame and allowing air to pass through and a lighting device disposed in the panel. The lighting device comprises a lampshade, in which a lighting part is disposed, and a circuitry box of a controller for controlling the lighting device. The lampshade and the circuitry box are formed in a separate structure such that the lampshade and the circuitry box may are made of metal and resin, respectively, wherein a gap is formed in a connection between the circuitry box and the panel, such that a water discharge structure communicated with the outside of the circuitry box is formed.

The lampshade and the circuitry box are both provided with a lead wire hole through which a lead wire passes between the lighting part and the controller.

The lead wire hole of the circuitry box is configured to be an oblique formation.

A water discharge port is provided in bottom of the wall of the circuitry box at which the lead wire hole is provided.

The panel is provided with a stop plate around which a bracket is provided, the bracket is provided with a notch communicated with inside of the panel in a side thereof, the circuitry box is configured to be a box body disposed in the bracket and for shielding the stop plate, a gap is formed between the side of the opening of the box body adjacent to the notch and the stop plate and configured to communicate with the notch.

As shown in FIG. 3, a lid 229 is disposed for the circuitry box at the lower side thereof, which is provided with a notch corresponding to the water discharge port 2291.

A groove is provided at a side of the stop plate with a width greater than the thickness of the wall of the box body of the circuitry box and a gap is formed between the groove and a side of the box body.

The panel is provided with grids through which air passes. With respect to the grids, the face forming a face of the panel is configured to be nearer to the outer surface and the stop plate is configured to be nearer to the inner face, such that the thickness of the grids is greater than a sum of those of the panel and the stop plate.

The stop plate is placed at a position at a higher level than that of the panel, such that the groove of the stop plate is formed by placing a side of the stop plate at a position at a same level as inner face of the panel.

The stop plate is provided with a chamfer thereby a structure directing to the groove is formed.

A side of the box body of the circuitry box is formed to be shorter than the other side thereof such that a gap is formed between the shorter side and the stop plate.

At least one of the following advantages of the present invention is achieved. A gap communicated with outside of the circuitry box is provided in a connection between the circuitry box and the panel, which allows water to be discharged through the gap from inside of the panel, even water would enter into the inside of the circuitry box. Therefore, an improved safety of the ventilation device is achieved.

DETAILED DESCRIPTION OF THE PREFERRED EMBODIMENT

Figure 1:
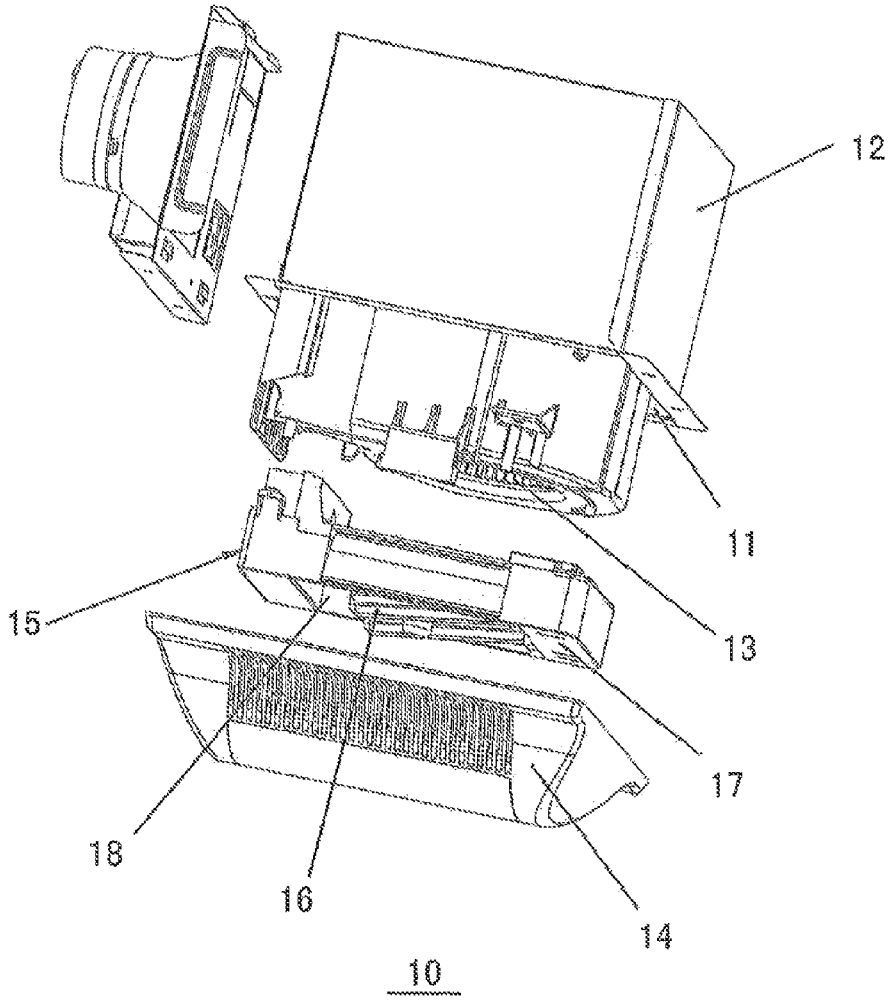
Fig. 1 PRIOR ART
FIG. 1 is a schematic view of the existing ventilation device in prior art.
Figure 2A:
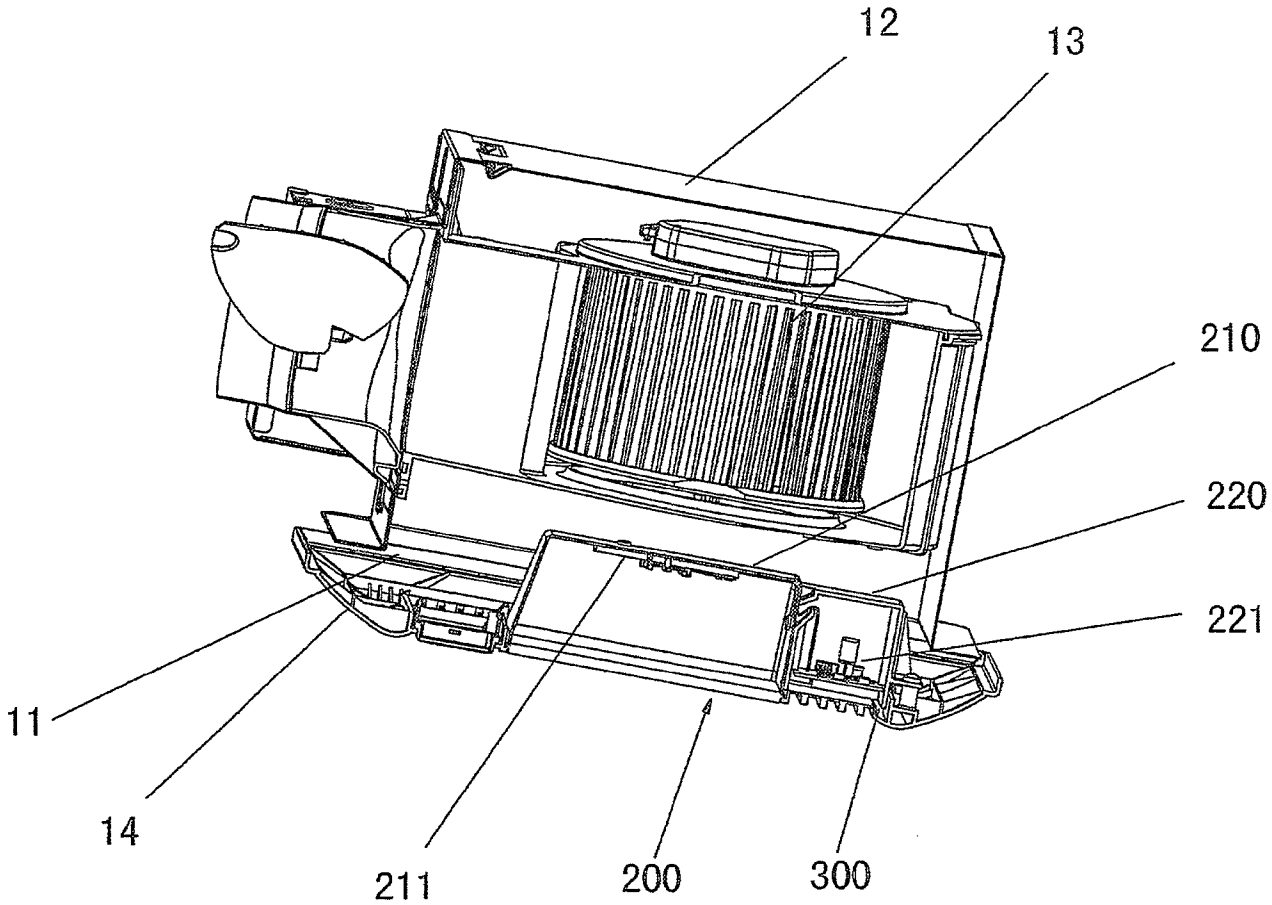
FIGS. 2A, 2B, 2C, 2D and 2E is a schematic view of a first embodiment of the present invention.

FIGS. 2A, 2B, 2C, 2D and 2E is a schematic view of a first embodiment of the present invention. FIG. 2A is a cut-away view of an entire ventilating fan. As illustrated in FIG. 2A, the ventilation device 100 includes a frame 12 with an opening 11, a fan 13 placed inside the frame 12, a panel 14 covering the opening 11 of the frame 12 and allowing air to pass therethrough, and a lighting device 200 disposed on the panel 14. The lighting device 200 has a lampshade 210, in which a lighting part 211 is placed, and a circuitry box 220 of a controller 221 for controlling the lighting part 211. The lampshade 210 and the circuitry box 220 are formed in a separated structure. The lampshade 210 is made of metal material while the circuitry box 220 is made of resin. The connection between the circuitry box 220 and the panel 14 is provided with a gap 300, such that a water discharge structure communicated with outside of the circuitry box 220 is formed.

Figure 2B:
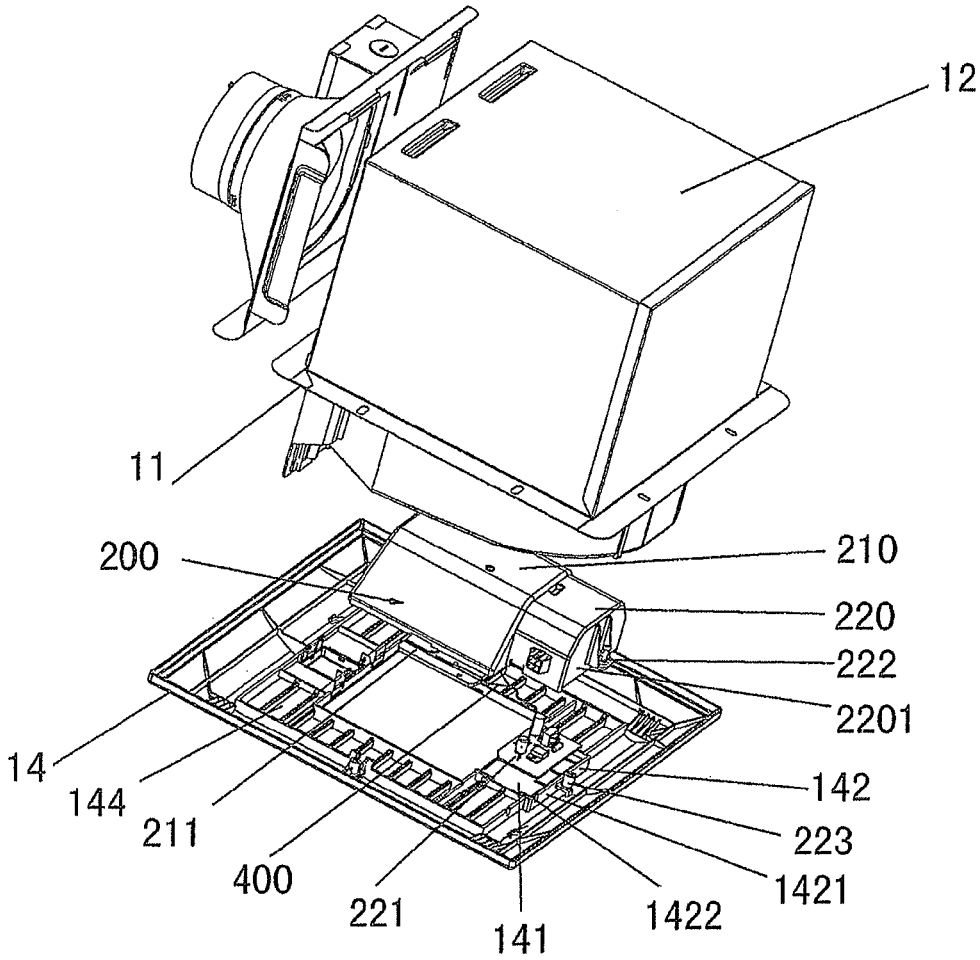
Figure 2C:
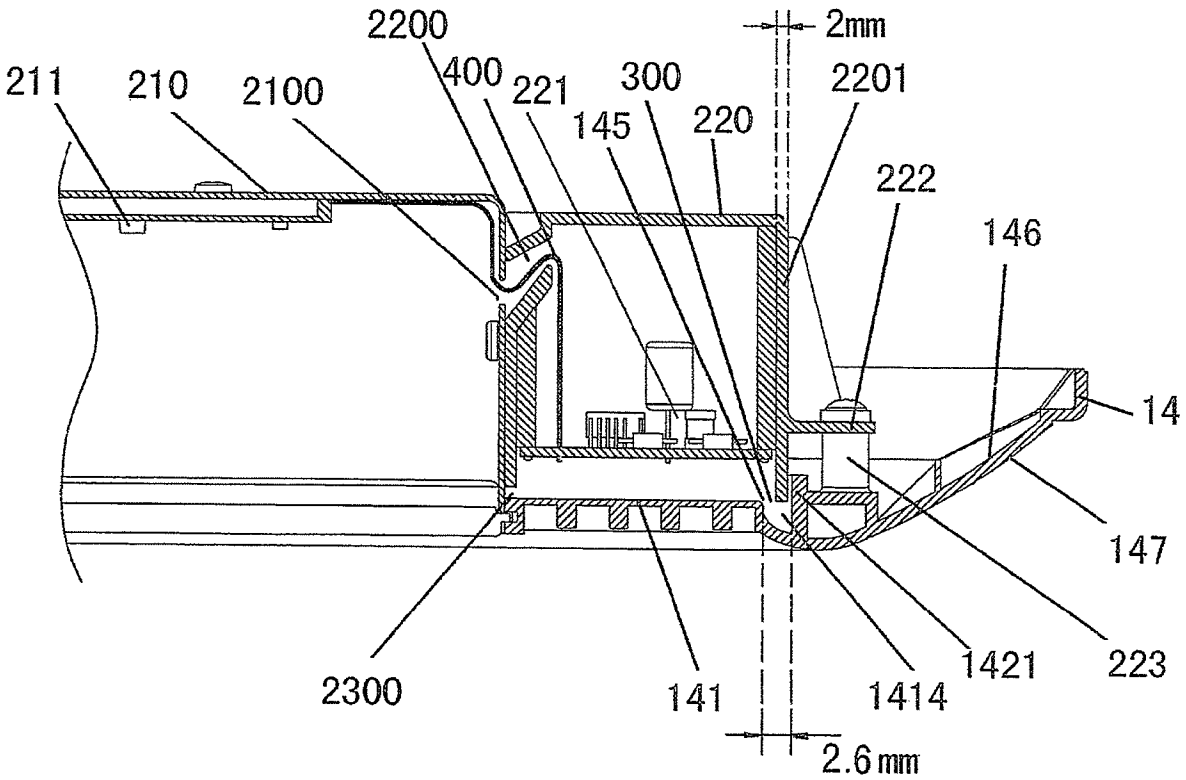

In FIG. 2B, in order to schematically illustrate the lighting part 211, the lighting part 211 is schematically shown below the disassembled lampshade 210. In the practical state, as shown in FIG. 2C, the lighting part 211 is a LED disposed in top face of the lampshade 210. In addition, in FIG. 2C, the circuitry box 220 is disposed adjacent to the lampshade 210 and the above mentioned LED is supplied with power under the control of the controller 221. The lampshade 210 and the circuitry box 220 are provided respectively with lead wire holes 2100 and 2200, through which a lead wire 400 passes between the lighting part 211 and the controller 221. The lead wire hole 2200 is configured to be in an oblique manner such that the position of the lead wire hole elevates along the direction from outside to inside of the circuitry box 220. That is, the lead wire hole 2200 is configured to have a- tube or cylinder formation in the direction along the thickness of the circuitry box 220 and the end of inner opening of the lead wire hole 2200 is provided at a higher level with relative to the end of outer opening thereof. Furthermore, the end of the outer opening is arranged at same level as the lead wire hole 2100. With this structure, the water would not enter into the circuitry box 220 along the lead wire 400 when there is water flowing along a gap between the circuitry box 220 and the lampshade 210, because the lead wire hole 2200 in the circuitry box 220 has an oblique structure and the opening of the lead wire hole 2200 of the circuitry box 220 is formed at a position at higher level than the lead wire hole 2100 of the lampshade 210.

When there is water flowing down along the gap between the circuitry box 220 and the lampshade 210, water will flow directly to bottom of the circuitry box 220 and the lampshade 210 along the gap therebetween, rather than enter into the circuitry box 220, and then be discharged through the water discharge port 2300 provided in the bottom of the wall of the circuitry box 220.

Again, as shown in FIGS. 2B and 2C, the panel 14 is provided with a stop plate 141 and a bracket 142 surrounding the stop plate 141. The bracket 142 is configured with a notch 1422 in a side 1421 to communicate with inside the panel 14. The above mentioned circuitry box 220 configured to be a box body disposed in the bracket 142 which provides a shielding for the stop plate 141. The opening side 2201 of the box body of the circuitry box 220 adjacent to the notch 1422 is formed with a gap 300 in relation to the stop plate 141, which is communicated with the notch 1422. With this configuration, water discharged from the water discharge port 2300 provided in the bottom of the wall of the circuitry box 220 may flow via the stop plate 141 and the water droplets attached to the stop plate 141 may flow from the gap 300 to the notch 1422, thereby being discharged outside of the panel 14. That is, a rapid discharge of water is achieved and durability of the product is increased.

A groove 1414 is provided with a width bigger than the thickness of the wall of the box body of the circuitry box 220 close to a side of the stop plate 141 and a gap 300 is formed between the stop plate 141 and a side of the box body. In a specific example, the thickness of the box body is 2 mm while the width of the groove is 2.6 mm.

As illustrated in FIG. 2B, the panel 14 is provided with grids 144 through which air passes. The grid 144 is formed such that its thickness is bigger than that of the face of the panel and the stop plate 141.

That is, the stop plate 141 is placed at a position at a higher level than the inside face 146 of the panel 14. The groove 1414 of the stop plate 141 is formed by placing a side of the stop plate 141 at a position at the same level as the inside face 146 of the panel 14.

Furthermore, a protrusion piece 222 is provided on the side 2201 of the circuitry box 220 facing the groove 1414 and it is fixed to a protrusion part 223 on the panel by means of a screw, it allows the position relationship between the groove 1414 and the side 2201 of the circuitry box 220 to be secured, thereby forming a water discharge. When the box body of the circuitry box 220 is received in the bracket 142, the side 2201 of the box body of the circuitry box 220 is not in contact with the stop plate 141, thereby the gap 300 is formed. Further, water droplets attached on the stop plate 141 may be discharged from inside of the stop plate 141 through the gap 300. The stop plate 141 is provided with a chamfer 145 on the end face, which leads to a structure directing to an inside of the groove 1414 and causes water droplets on the stop plate 141 to be guided to the groove 1414.

Figure 2D:
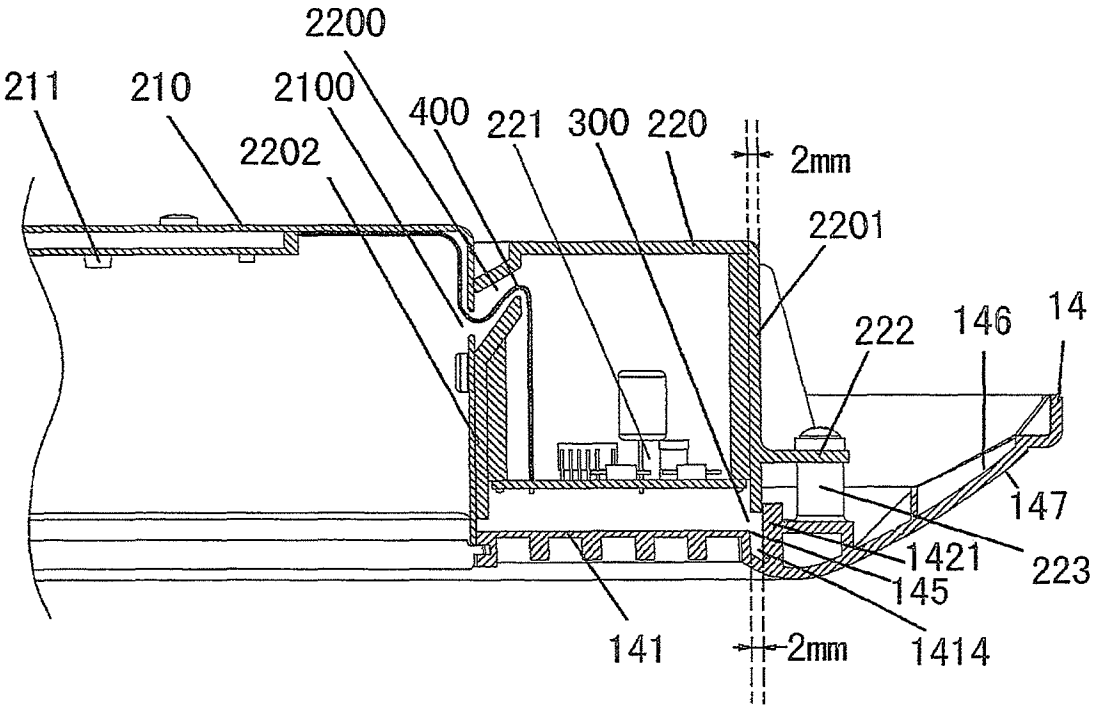
Figure 2E:
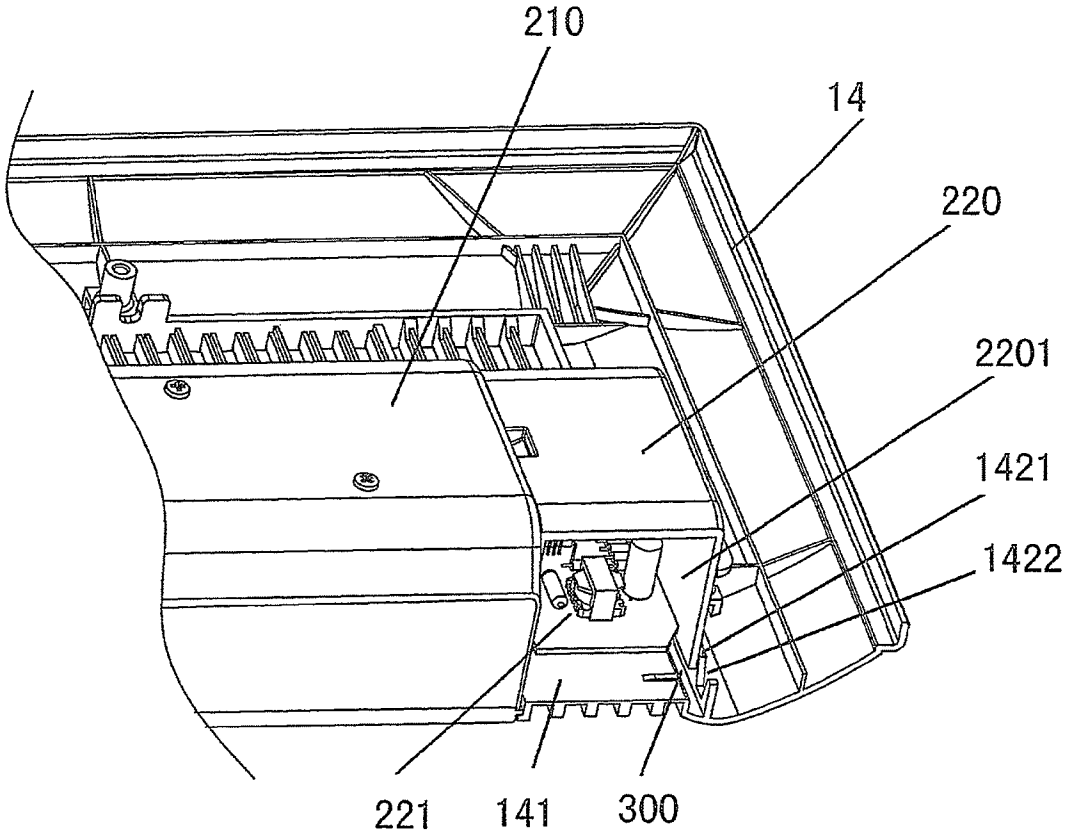

As illustrated in FIG. 2D, an another embodiment of the circuitry box 220 is shown, in which the side 2201 of the box body of the circuitry box 220 is formed to be shorter than the other side 2202 and a gap 300 is formed between the side 2201 of the box body 2201 and the stop plate 141. With this structure, even though a groove 1414 with a width greater than thickness of the wall of the box body of the circuitry box 220 as mentioned above, i.e., for example, the wall of the box body is 2 mm and the width of the groove is 2 mm in thickness, were not provided, the gap 300 could still be achieved as the short side 2201 is not in contact with the stop plate 141. Further, the water droplets attached on the stop plate 141 can be drained or discharged out from inside of the stop plate 141 through the gap 300.

Figure 3:
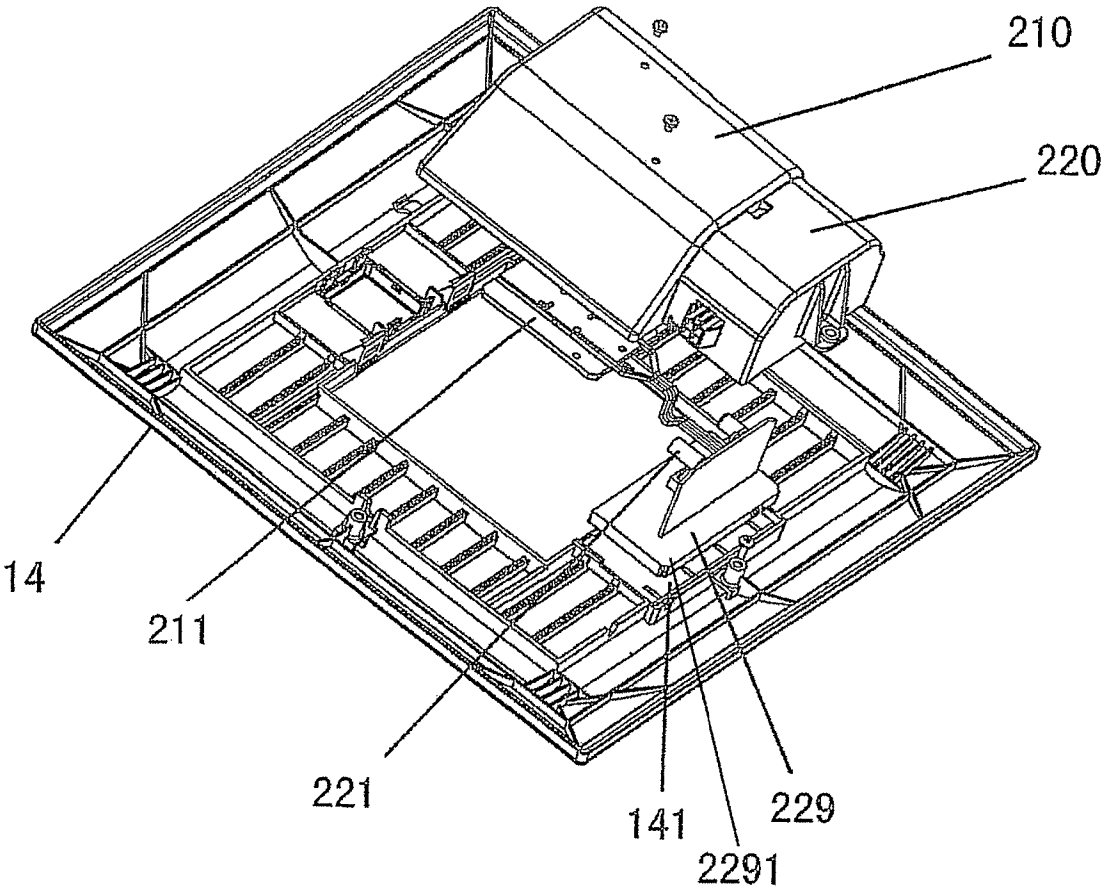
FIG. 3 is a schematic illustration showing a second embodiment of the present invention.

FIG. 3 is a schematic view of the second embodiment of the present invention. As shown in FIG. 3, the controller 221 for controlling the lighting part 211 mounted in the circuitry box 220 is arranged in vertical direction and a lid 229 is disposed below the circuitry box 220. With this arrangement, due to the lid 229, the controller 221 may contact with the lid 229 via an end face and water cannot enter into the controller 221, even water could overflow over the stop plate 141.

What is claimed is:

1. A ventilation device, comprising:

a frame provided with an opening;

a fan disposed in the frame;

a panel covering the opening of the frame and allowing air to pass through, and a lighting device disposed in the panel, wherein:

the lighting device includes a lampshade, in which a lighting part is disposed, and a circuitry box of a controller for controlling the lighting part, the lampshade and the circuitry box being formed in a separated structure, wherein the panel is provided with a stop plate and a bracket surrounding the stop plate, the bracket being configured with a notch in a side to communicate with inside the panel, and wherein, a lid is disposed for the circuitry box at a lower side thereof, which is provided with a water discharge port corresponding to the notch.

2. The ventilation device according to claim 1, wherein:

the lampshade and the circuitry box are both provided with a lead wire hole through which a lead wire passes between the lighting part and the controller.

3. The ventilation device according to claim 2, wherein: the lead wire hole of the circuitry box is configured to be an oblique formation.

4. The ventilation device according to claim 1, wherein: a groove is provided at a side of the stop plate with a width greater than the thickness of a wall of the circuitry box and a gap is formed between the groove and the side of the circuitry box.

5. The ventilation device according to claim 4, wherein: the panel is provided with grids through which air passes.

6. The ventilation device according to claim 5, wherein: the stop plate is placed at a position at a higher level than that of the panel, such that the groove of the stop plate is formed by placing a side of the stop plate at a position at a same level as inner face of the panel.

7. The ventilation device according to claim 5, wherein: the stop plate is provided with a chamfer thereby a structure directing to the groove is formed.

8. The ventilation device according to claim 1, wherein: a side of the circuitry box is formed to be shorter than the other side thereof such that a gap is formed between the shorter side and the stop plate.

* * * * *